United States Patent [19]

Wolf

[11] Patent Number: 4,569,666

[45] Date of Patent: Feb. 11, 1986

[54] COMBAT ACTION FIGURES

[76] Inventor: Tobin Wolf, 1610 Harmon Cove Towers, Secaucus, N.J. 07094

[21] Appl. No.: 617,592

[22] Filed: Jun. 5, 1984

[51] Int. Cl.[4] ..... A63H 13/10

[52] U.S. Cl. ..... 446/308; 446/473

[58] Field of Search ..... 446/309, 308, 473, 399, 446/400, 401, 418, 336, 268; 124/27, 37

[56] References Cited

U.S. PATENT DOCUMENTS

| | | | |
|---|---|---|---|
| 505,344 | 9/1893 | Beaumont | 446/308 |
| 2,185,091 | 12/1939 | Orlando et al. | 446/308 |
| 2,618,885 | 11/1952 | Tigrett | 446/473 |
| 2,888,768 | 6/1959 | Taylor | 124/27 X |

FOREIGN PATENT DOCUMENTS

| | | | |
|---|---|---|---|
| 684848 | 12/1939 | Fed. Rep. of Germany | 446/308 |
| 1142304 | 1/1963 | Fed. Rep. of Germany | 446/308 |
| 1154633 | 4/1958 | France | 446/309 |

*Primary Examiner*—Mickey Yu
*Attorney, Agent, or Firm*—Jay M. Cantor

[57] ABSTRACT

Action figures or super hero types of dolls wherein actual and realistic combat confrontations between hero and enemy can take place, the figures taking the shape of human beings, animals, robots or the like. A super hero doll or action figure carrying a simulated weapon such as a laser gun, the weapon having a retracted projectile therein with a spring force applied thereto, the projectile being held in place by a latching member on the gun. A trigger is positioned in the body of the action figure which, when moved by the finger of the player in a forward direction, rotates the latch which is pivotally mounted on the gun. This removes the latching action on the projectile and permits the spring member, which was in compressed condition, to expand and move the projectile outwardly. A flange is provided on the projectile to contact a lip at the end of the gun barrel and prevent the projectile from leaving the gun in the form of a free flying missile or the like. The opposing force or enemy is also a toy in the form of an action figure carrying a breast plate in front of the body which is normally spring biased away from the body. The breast plate is the end portion of a lever which is pivotally secured within the body torso at a central part of the lever, the end of the lever including a finger which latches into a notch on a rotating drum. The drum is secured to the legs of the figure and carries an expanded spring thereon which is secured at its other end within the action figure torso. When the breast plate is moved inwardly toward the body and against the biasing force of the spring on the lever, the finger is removed from the notch in the drum and permits the drum and legs secured thereto to rotate relative to the torso under the force of the spring attached to the drum and torso, thereby causing rotation at the waist to the point where the center of gravity is no longer over the feet of the action figure. At this point the action figure will fall over to simulate an injured or fatally wounded animal, human or robot or the like.

6 Claims, 5 Drawing Figures

FIG. 1
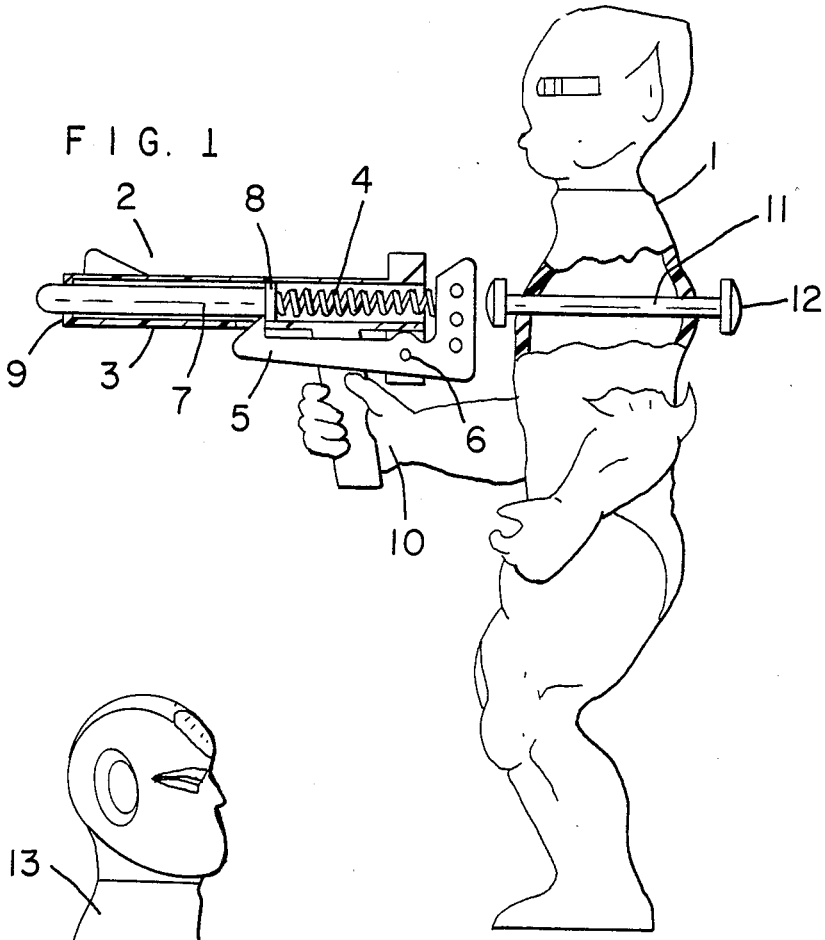
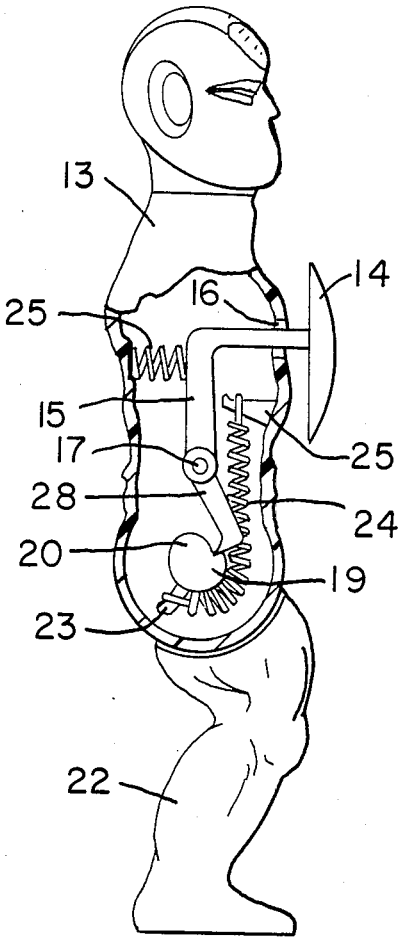
FIG. 3
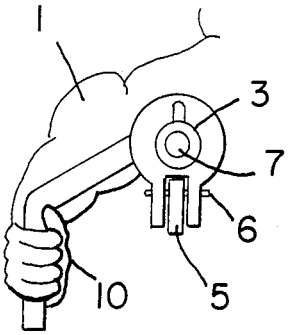
FIG. 2

FIG. 4
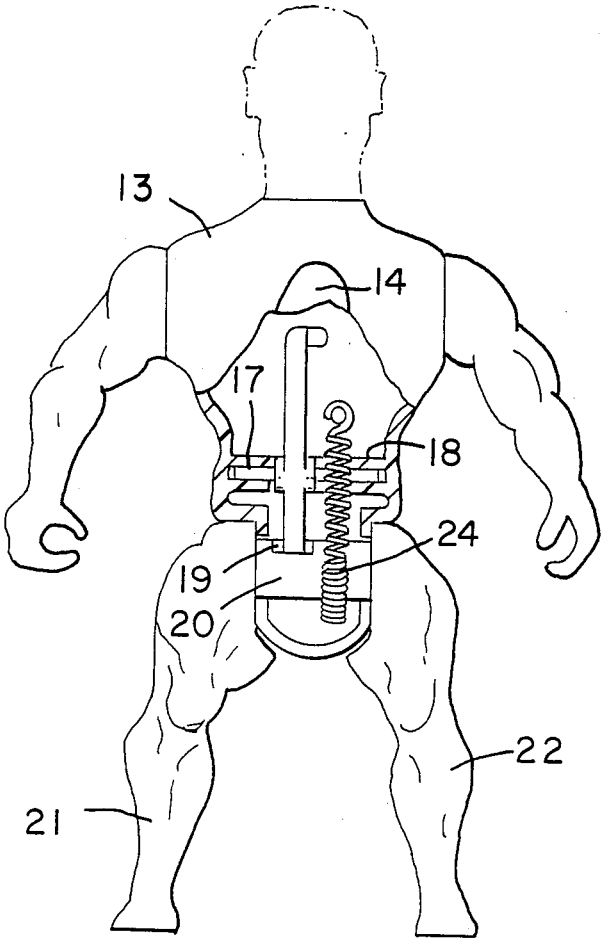
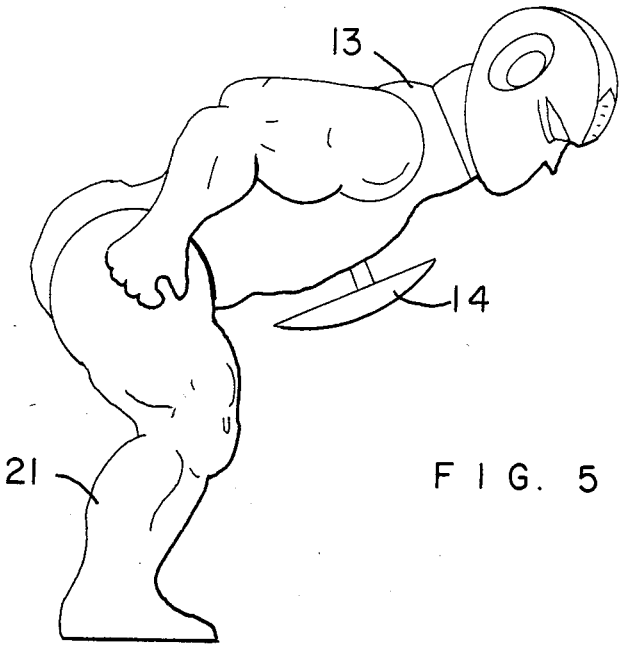
FIG. 5

COMBAT ACTION FIGURES

BACKGROUND OF THE INVENTION

1. Field of the Invention

This invention relates to action figures, such as soldiers, robots and the like, and provides means for an actual combat confrontation between hero and enemy utilizing the figures.

2. Description of the Prior Art

Prior art dolls, toys and the like which attempt to simulate actual life combat are known in the art. Such prior art figures normally are found in the form of rigid molded members such as toy soldiers, and are incapable of performing actual combat functions. Other types of prior art toys of the above described type are capable of performing a single or plural combat function or functions, however the prior art does not disclose such action on a realistic basis wherein interaction with an enemy also takes place with realistic action being performed by the enemy as well.

SUMMARY OF THE INVENTION

In accordance with the present invention, there are provided action figures or super hero types of dolls wherein actual and realistic combat confrontations between hero and enemy can take place, the figures taking the shape of human beings, animals, robots or the like.

Briefly, in accordance with the present invention, there is provided a super hero doll or action figure carrying a simulated weapon such as a laser gun, the weapon having a retracted projectile therein with a spring force applied thereto, the projectile being held in place by a latching member on the gun. A trigger is positioned in the body of the action figure which, when moved by the finger of the player in a forward direction, rotates the latch which is pivotally mounted on the gun. This removes the latching action on the projectile and permits the spring member, which was in compressed condition, to expand and move the projectile outwardly. A flange is provided on the projectile to contact a lip at the end of the gun barrel and prevent the projectile from leaving the gun in the form of a free flying missile or the like.

The opposing force or enemy is also a toy in the form of an action figure carrying a breast plate in front of the body which is normally spring biased away from the body. The breast plate is the end portion of a lever which is pivotally secured within the body torso at a central part of the lever, the end of the lever including a finger which latches into a notch on a rotating drum. The drum is secured to the legs of the figure and carries an expanded spring thereon which is secured at its other end within the action figure torso.

When the breast plate is moved inwardly toward the body and against the biasing force of the spring on the lever, the finger is removed from the notch in the drum and permits the drum and legs secured thereto to rotate relative to the torso under the force of the spring attached to the drum and torso, thereby causing rotation at the waist to the point where the center of gravity is no longer over the feet of the action figure. At this point the action figure will fall over to simulate an injured or fatally wounded animal, human or robot or the like.

BRIEF DESCRIPTION OF THE DRAWINGS

FIG. 1 is a side view, partially cut away, of an action figure in accordance with the first embodiment of the present invention;

FIG. 2 is a front view of a portion of FIG. 1;

FIG. 3 is a side view, partially cut away, of an action figure in accordance with the second embodiment of the present invention;

FIG. 4 is a front view, partially cut away, of the action figure of FIG. 3; and FIG. 5 is a side view of the figure of FIGS. 3 and 4 in a rotated condition just prior to tipping over.

DESCRIPTION OF THE PREFERRED EMBODIMENTS

Referring first to FIGS. 1 and 2, there is shown an action figure 1 in the form of a robot holding a fantasy weapon in the form of a "ray" or "laser" gun 2, the laser gun including a barrel 3 having a compression spring 4 disposed in the rearward portion thereof and a projectile 7 which, in the present embodiment, is utilized to simulate a laser ray. The projectile includes a flange 8 at its rearward portion which is secured to or positioned against the compression spring 4. A releasable latch member 5 is pivotally mounted on the gun 2 at the pivot 6 with the spring member 4 being attached at its other end to a portion of the latch adjacent the rear portion of the barrel 3. The latch member 5 includes a latching finger which engages the flange 8 to maintain the projectile 7 within the barrel with the spring 4 under compression. The projectile 7 is molded preferably of a fluorescent plastic to provide a simulation of a laser ray and is slidably mounted within the barrel 3. For safety reasons, the movement of the projectile 7 is limited by a lip 9 at the forward end of the barrel 3 so that the projectile can not become a free flying missile by moving out of the barrel under the force provided by the compression spring 4 after the latch 5 has been removed from the flange 8.

The action figure 1 further includes a trigger 11, slidably mounted therein and movable against the latch member 5 to rotate the latch member about the pivot 6 in a manner to unlatch the latch member from the flange 8. The trigger 11 includes a pair of buttons 12 external of the body of the action figure 1 on both sides of the trigger whereby movement of the button 12 to the rear of the figure in the direction of the gun will cause the releasable latch 5 to pivot about the pivot 6 and permit the compression spring 4 to expand, thereby driving the projectile 7 in a direction out of the barrel until the flange 8 contacts the lip 9 and halts the projectile movement to simulate a laser ray travelling out of the gun 2.

Referring now to FIGS. 3 and 4, there is shown an action figure or toy in accordance with the second embodiment of the invention having a torso portion 13 and legs 21 and 22. The action figure includes a breast plate or shield 14 movably mounted in front of the torso portion 13 of the figure. The breast plate 14 is affixed to a lever 15 which protrudes through a central aperture 16 in the torso portion 13 of the action figure, the lever 15 being pivotally mounted on the inside of the torso portion via a pin 17 located by the ribs 18 within the doll torso portion. The lower end of the lever 15 includes a latch portion 28 which engages a notch 19 in a rotatable drum 20. The drum 20 is secured to the legs 21 and 22 and is an integral part of said legs. The legs 21 and 22 are not secured to the torso portion 13. Also affixed to the drum 20 or being a portion thereof is a lug 23 to which a tension spring 24 is attached and affixed, the other end of the spring 24 being secured to a lug 25 molded to the inner side of the torso portion 13. A compression spring 25 is secured to the inside rear portion of the torso portion 13 and to the upper portion of the lever 15 and imparts a clockwise bias to the lever 15 as shown in FIG. 3 so that the breast plate 14 is normally disposed away from the body of the action figure. It can therefore be seen that, in the state as shown in FIGS. 3 and 4, the torso portion 13 will stand above the legs 21 and 22 in an erect position, thereby placing the center of gravity of the doll over the feet of the figure and permitting the figure to stand upright.

It is apparent from the above discussion that a slight pressure on the breast plate 14, such as a firing of the laser gun 2 and having the projectile 7 hit against the breast plate 14, will impart counterclockwise rotation as shown in FIG. 3 to the lever 15, thereby unlatching the latch portion 28 from the drum 20 and permitting the torso portion 13 to rotate in a clockwise direction. This will cause a rotation of the torso portion 13 of the action figure relative to the legs 21 and 22 and impart a clockwise rotation of the torso portion relative to the legs with the result that the torso will bend over in the manner shown in FIG. 5. As the center of gravity of the action figure is gradually moved forward and ceases to be over the feet thereof, the doll will then fall over due to gravitational force thereon and simulate a mortally wounded or injured combatant. It can be seen that, in accordance with the present invention, a pair of combatants is provided whereby the action, though simulated, is realistic and yet safe for use with small children since no flying projectiles are present.

Though the invention has been described with respect to specific preferred embodiments thereof, many variations and modifications will immediately become apparent to those skilled in the art. It is therefore the intention that the appended claims be interpreted as broadly as possible in view of the prior art to include all such variaions and modifications.

What is claimed is:

1. A toy which comprises, in combination:

(a) a toy action figure comprising a body having an aperture therethough, a trigger member slidably disposed in said aperture and extending from both sides of the body, and (b) utilization means secured to said body and including (c) a barrel spaced from the trigger member, (d) a projectile slidably supported within said barrel at the upstream portion thereof, (e) force means in the downstream portion of said barrel capable of applying a force to said projectile, and (f) latching means responsive to movement of said trigger member for causing said force means to apply a force to said projectile.

2. A toy as set forth in claim 1 wherein said force means is a spring and said projectile includes a flange latchable to said latching means.

3. A toy as set forth in claim 1 wherein said projectile includes a flange at its downstream end for latching with said latching means and said barrel supports lip means at its upstream end for engaging said flange.

4. A toy as set forth in claim 2 wherein said projectile includes a flange at its downstream end for latching with said latching means and said barrel supports lip means at its upstream end for engaging said flange.

5. A toy as set forth in claim 3 wherein said latching means includes a latch for engaging said flange and a further portion for engaging said trigger and pivot means positioned between said latch and said further portion for pivotally securing said latching means to said barrel.

6. A toy as set forth in claim 4 wherein said latching means includes a latch for engaging said flange and a further portion for engaging said trigger and pivot means positioned between said latch and said further portion for pivotally securing said latching means to said barrel.

* * * * *